United States Patent [19]

Yokoyama

[11] Patent Number: 4,987,564

[45] Date of Patent: Jan. 22, 1991

[54] ACOUSTIC APPARATUS

[75] Inventor: Kenji Yokoyama, Hamamatsu, Japan

[73] Assignee: Yamaha Corporation, Hamamatsu, Japan

[21] Appl. No.: 517,416

[22] Filed: Apr. 26, 1990

Related U.S. Application Data

[63] Continuation of Ser. No. 286,869, Dec. 19, 1988, abandoned.

[30] Foreign Application Priority Data

Dec. 28, 1987 [JP] Japan ..... 62-334262

[51] Int. Cl.[5] ..... H04R 3/00

[52] U.S. Cl. ..... 367/140; 181/182; 181/184; 181/160; 381/96

[58] Field of Search ..... 367/140, 191; 181/182, 181/184, 159, 160, 175, 206, 207; 381/96

[56] References Cited

U.S. PATENT DOCUMENTS

| | | | |
|---|---|---|---|
| 2,887,532 | 5/1959 | Werner | 381/96 |
| 3,037,081 | 5/1962 | Carlsson | 381/90 |
| 3,864,532 | 2/1975 | Van Der Plaats et al. | 340/328 |
| 4,118,600 | 10/1978 | Stahl | 179/1 |
| 4,387,270 | 6/1983 | Sakano et al. | 381/96 |
| 4,419,545 | 12/1983 | Kuindersma | 181/184 |
| 4,602,245 | 7/1986 | Yang et al. | 310/322 |
| 4,712,247 | 12/1987 | Swarte | 381/96 |
| 4,741,040 | 4/1988 | Kaizer | 381/96 |

OTHER PUBLICATIONS

"Synthesis of Loudspeaker Mechanical Parameters by Electrical Means: A New Method for Controlling Low-Frequency Loudspeaker Behavior" by Karl Erik Stahl, 61st Convention of the Audio Engineering Society, New York, 1978; Revised 1981.

"Loudspeakers In Vented Boxes: Part I", A. N. Thiele, Journal of Audio Engineering Society, pp. 382-392, May 1971, vol. 19, No. 5.

"Loudspeakers in Vented Boxes: Part II", A. N. Thiele, Journal of Audio Engineering Society, pp. 471-483, Jun. 1971, vol. 19, No. 6.

"Effect Of A Negative Impedance Source On Loudspeaker Performance" by Richard E. Werner, The Journal of The Acoustical Society; vol. 6, No. 4, Oct. 1958.

"A New Approach to Loudspeaker Damping"; Warner Clements, Audio Engineering; Aug. 1951.

*Primary Examiner*—Charles T. Jordan
*Assistant Examiner*—J. Woodrow Eldred
*Attorney, Agent, or Firm*—Spensley, Horn, Jubas & Lubitz

[57] ABSTRACT

An acoustic apparatus comprising a resonator having a resonance radiation unit for radiating an acoustic wave by resonance, a vibrator arranged in the resonator, and a vibrator drive means for driving the vibrator. The vibrator has a diaphragm having a direct radiator portion for directly radiating an acoustic wave, and a resonator driver portion for driving the resonator. The vibrator drive means has a drive control means for controlling the drive condition so as to equivalently reduce or invalidate the internal impedance inherent to the vibrator.

17 Claims, 20 Drawing Sheets

ACOUSTIC APPARATUS

This is a continuation of copending application Ser. No. 286,869 filed on Dec. 19, 1988 now abandoned.

BACKGROUND OF THE INVENTION

1. Field of the Invention

The present invention relates to an acoustic apparatus including a resonator.

2. Prior Art

A speaker system as one type of acoustic apparatus is arranged such that a speaker unit (vibrator) is disposed in a cabinet and is driven by an amplifier (AMP). Of reproduction characteristics of the speaker system, low-frequency reproduction characteristics are mainly determined by the volume of the cabinet.

A dynamic direct radiator speaker (dynamic cone speaker) as a typical direct radiator type speaker has a substantially conical diaphragm. The diaphragm is driven by a voice coil in a magnetic gap attached near the top of the cone. When such a speaker is used in the acoustic apparatus, a direct sound is radiated from the front surface of the diaphragm, and acoustic waves are also radiated from its rear surface. The acoustic waves from the front and rear surfaces have opposite phases. Therefore, if a difference in propagation distance of the acoustic waves from the front and rear surfaces to a listener is almost an odd multiple of a half wavelength, sound pressures from these surfaces are in phase with each other, and are superposed.

However, if the difference in propagation distance of the acoustic waves is almost an even multiple of the half wavelength, the sound pressures cancel each other and are attenuated. Thus, taking into consideration the fact that sounds having various wavelengths are radiated from the speaker, it is preferable that the sound from the rear surface does not reach the listener or the sound from the rear surface does not adversely influence the direct radiation sound from the front surface.

For this purpose, the direct radiator type speaker employs a baffle. As a baffle for shielding communication of sounds from the front and rear surface of the diaphragm, a plane baffle, back-opening cabinet type baffle, closed baffle, and the like are known, as shown in FIGS. 29A to 29C. Furthermore, as a baffle having a slightly different purpose than the above baffles, a phase inversion type (bass-reflex type) baffle shown in FIG. 31 is known. These baffles will be described below.

FIG. 29A is a sectional view of a plane baffle. A hole having the same size as a vibrator is formed in a single, wide flat plate 1, and a substantially conical diaphragm 2 is mounted in this hole. A dynamic electroacoustic transducer (speaker) 3 including a voice coil, a magnetic circuit, and the like is attached to the top portion of the cone of the diaphragm 2. According to this plane baffle, since a sound from the rear surface is shielded by the plate 1, if the plate 1 is assumed to have an infinite size, a perfect baffle effect can be obtained. However, a plate having an infinite size is not realistic, and in practice, a plate 1 having a finite size is used. If a minimum frequency of sound pressure reproduction characteristics is set to be about 60 Hz, the plate 1 must be a 2×2 (m) square, and cannot be put into a practical use.

FIG. 29B is a sectional view of a back-opening cabinet type baffle As shown in FIG. 29B, a hole is formed in a cabinet 4 open at its rear end and a vibrator constituted by a dynamic speaker 3 having a diaphragm 2 is mounted in this hole. However, according to the back-opening cabinet type baffle, the speaker system must have a large size in order to obtain a necessary baffle effect. An air column in the cabinet 4 constitutes a resonance system, and impairs a transient response.

FIG. 29C is a sectional view of a closed baffle. As shown in FIG. 29C, a hole is formed in the front surface of a closed cabinet 5, and a vibrator constituted by a dynamic speaker 3 having a diaphragm 2 is mounted in this hole. With this structure, if the cabinet 5 can be perfectly prevented from being vibrated, the sound from the rear surface of the diaphragm 2 can be perfectly enclosed, thus obtaining a perfect baffle effect. However, air enclosed in cabinet 5 serves as an air spring, and gives an elasticity to the diaphragm 2. As a result, a resonance frequency as a whole undesirably becomes higher than that of the plane baffle.

This principle will be explained below with reference to FIG. 30. FIG. 30 shows a simplified electric equivalent circuit of the system shown in FIG. 29C. In FIG. 30, reference symbol $R_v$ denotes a DC resistance of a voice coil of the vibrator, and $m_o$, $S_o$, and $S_c$ have the following relationships:

$m_o$: equivalent mass of vibration system $S_o$: equivalent stiffness of vibration system $S_c$: equivalent stiffness of cabinet Reference symbol A denotes a force coefficient, which is given by $A=Bl_v$ where B is the magnetic flux density in a magnetic gap and $l_v$ conductor length of the voice coil. A parallel resonance circuit $Z_1$ by an equivalent motional impedance of the unit vibration system and an equivalent motional impedance $A^2/S_c$ of the closed cabinet are connected in parallel with each other, and the parallel circuit is connected in parallel with an amplifier (not shown) through the voice coil resistance $R_v$ as a non-motional impedance.

As can be seen from this electric equivalent circuit, a resonance frequency $f_{oc}$ of a whole system is increased to be higher than a minimum resonance frequency $f_o$ of the vibrator and is given by:

$$f_{oc}=f_o(1+S_c/S_o)^{\frac{1}{2}}$$

An equivalent Q value ($Q_{oc}$) of the whole system at the resonance frequency $f_{oc}$ has the following relationship with respect to a Q value ($Q_o$)of the vibrator itself at the minimum resonance frequency $f_o$ and is increased as:

$$Q_{oc}=Q_o(1+S_c/S_o)^{\frac{1}{2}}$$

Therefore, in order to improve low-frequency reproduction characteristics, the equivalent stiffness $S_c$ of the cabinet must be decreased For this purpose, a large cabinet must be employed.

A bass-reflex type speaker system has a slightly different purpose from the above-mentioned baffles. FIGS. 31A and 31B are a perspective view and a sectional view of the bass-reflex type speaker system. As shown in FIGS. 31A and 31B, a hole is formed in a cabinet 6, and a vibrator consisting of a diaphragm 2 and a dynamic speaker 3 is mounted in this hole. An opening port 8 having a sound path 7 is arranged below the vibrator. In a conventional bass-reflex type speaker system, a resonance frequency $f_{op}$ caused by an air spring in the cabinet 6 and an air mass of the sound path 7 is set to be lower than the minimum resonance frequency $f_o$ of the vibrator (speaker) which is assembled in the bass-reflex type cabinet. At a frequency higher than the resonance frequency $f_{op}$ caused by the air spring and the air mass, the sound pressure from the rear surface of the diaphragm 2 has an opposite phase in the sound path 7, and hence, the direct radiation sound from the front surface of the diaphragm 2 and the sound from the opening port 8 are consequently in phase with each other, thus increasing the sound pressure. As a result, according to an optimally designed bass-reflex type speaker system, the frequency characteristics of an output sound pressure can be expanded below the low-frequency resonance frequency of the vibrator. As indicated by an alternate long and two short dashed curve in FIG. 32, a uniform reproduction range can be extended wider than those of the infinite plane baffle and the closed baffle.

However, when uniform reproduction is realized by the bass-reflex type speaker system, various limitations are posed on the Q value of resonance of a unit vibration system and the like, and only when these limitations are met, the characteristics shown in FIG. 32 can be obtained. In this manner, in the conventional bass-reflex type speaker system, it is very difficult to obtain an optimal design condition.

On the other hand, an attempt is made to intentionally extremely reduce the resonance frequency $f_{op}$ of the resonator regardless of the basic design idea of the bass-reflex type speaker system and paying attention to only an acoustic radiation power from the opening port.

However, since the bass reproduction power is closely related to the volume of the cabinet, a larger cabinet must be employed in any event in order to achieve low-frequency reproduction, as is the case with a closed baffle. This situation will be explained in detail below with reference to FIG. 33.

FIG. 33 shows a simplified electric equivalent circuit of the bass-reflex type speaker system shown in FIG. 31. In FIG. 33, reference symbols A, $R_v$, $m_o$, $S_o$, and $S_c$ are the same as those in FIG. 30, and $m_p$ corresponds to an equivalent mass of the sound path (port). A parallel resonance circuit $Z_1$ by an equivalent motional impedance of the unit vibration system and a series resonance circuit $Z_2$ by an equivalent motional impedance of a port resonance system are connected in parallel with each other, and this parallel circuit is connected in parallel with a driving amplifier (not shown) through the voice coil resistance $R_v$ as non-motional impedance.

As can be seen from this electric equivalent circuit, the bass-reflex type speaker system includes two resonance systems according to its major characteristic feature. The impedance characteristics of this speaker system present a double-humped curve having a total of three resonance points, i.e., two maximum peaks and one minimum peak therebetween. The resonance point of the minimum peak corresponds to the port resonance system (the above-mentioned closed baffle has only one resonance system, and its impedance characteristics exhibit a single-humped curve including only one resonance point). In the bass-reflex type speaker system, the voice coil resistance $R_v$ of the vibrator (unit) serves as both a damping resistance of the parallel resonance circuit $Z_1$ of the vibrator side and the series resonance circuit $Z_2$ of the opening port (duct) side. For this reason, the parallel and series resonance circuits $Z_1$ and $Z_2$ mutually interfere with each other.

As an example of mutual interference or mutual dependency, if a vibrator having a strong magnetic circuit is used, a resonance Q value of the vibrator is reduced, while the resonance Q value of the opening port is increased. In contrast to this, if a vibrator having a weak magnetic circuit is used, the opposite situation to the above occurs. In an essential design of the bass-reflex type speaker system, an optimal point capable of obtaining uniform low-frequency reproduction characteristics must be selected under the conflicting mutual dependency condition.

Assume that the volume of the cabinet is reduced. In this case, the minimum resonance frequency $f_o$ of the unit vibration system exhibits the same tendency as that of the closed baffle, and as a result, is increased. The low-frequency reproduction characteristics will finally come to be improved to some extent by the acoustic radiation effect of the opening port. However, if the size of the cabinet is reduced, it cannot be avoided that the low-frequency reproduction power will be decreased as the whole system even in the bass-reflex type speaker system.

In particular, when the resonance frequency $f_{op}$ of the port resonance system is intentionally decreased from basic setting, as described above, the opening port must be more elongated as the cabinet is smaller in size. Therefore, the Q value becomes very small due to an increase in mechanical resistance of air in the port. An extreme decrease in resonance Q value leads to loss of the acoustic radiation power from the opening port. As a result, the function of the opening port as a resonance duct is lost, and the presence of the opening port becomes meaningless. That is, if the size of the cabinet is reduced, bass reproduction is essentially impossible.

As has been schematically described above, in the conventional acoustic apparatus, various countermeasures are taken in order to allow low-frequency reproduction.

The plane baffle, back-opening baffle, and closed baffle shown in FIGS. 29A to 29C are designed such that radiation sounds from the rear surface of the diaphragm do not reach a listener in front of the speaker system as unnecessary sounds. However, in order to improve the bass reproduction characteristics with these baffles, the apparatus (cabinet) will inevitably be made large in size, and even if it is made so to a certain feasible extent, its low-frequency reproduction characteristics will be insufficient.

In the bass-reflex type speaker system shown in FIGS. 31A and 31B, the phase of the backward sound is inverted by the opening port, so that in particular, a bass range of a direct radiation sound from the front surface of the diaphragm is compensated for. For this reason, the resonance system which is originally very hard to deal with is undesirably formed on the two portions, i.e., the diaphragm and the opening port. In order to obtain a satisfactory bass-reflex effect according to the basic setting, the optimal condition of the system must be very critically set while taking the mutual dependency condition of these two resonance systems. Although various attempts have been made in this respect as disclosed in Japanese Patent Publication No. sho 46-12670 and Japanese Utility Model Publication No. sho 54-35068, these attempts could not eliminate difficulty on design.

In order to improve the low-frequency reproduction characteristics, in any way, the cabinet undesirably becomes bulky.

In some bass-reflex type speaker systems, the resonance frequency $f_{op}$ of the port resonance system is intentionally decreased from its basic setting. However, if the size of the cabinet is to be reduced, the port resonance system will not significantly contribute to acoustic radiation, thus incurring a fatal drawback.

Therefore, when a bass reproduction power of a certain level or higher is to be obtained according to any of the prior arts, the resulting cabinet will inevitably become large in size. As a result, it is difficult to employ an acoustic apparatus having a cabinet of a proper volume and excellent low-frequency reproduction characteristics in a variety of applications such as in halls, rooms, vehicles, and the like.

SUMMARY OF THE INVENTION

The present invention has been made in consideration of the above situation, and has as its object to provide an acoustic apparatus which can appropriately and independently set a volume of a cabinet or the like constituting the acoustic apparatus and low-frequency reproduction characteristics, and can remove or reduce a mutual dependency condition of a vibrator and a resonator.

The acoustic apparatus according to the present invention comprises a resonator having a resonance radiation unit for radiating an acoustic wave by resonance, a vibrator arranged in the resonator, and a vibrator drive means for driving the vibrator. The vibrator has a diaphragm having a direct radiator portion for directly radiating an acoustic wave, and a resonator driver portion for driving the resonator. The vibrator drive means has a drive control means for controlling the driving condition so as to equivalently reduce or invalidate the internal impedance inherent to the vibrator.

With the above arrangement, the resonator is driven by the resonator driver portion of the vibrator. Therefore, an acoustic wave is directly radiated from the direct radiator portion of the vibrator, and an acoustic wave by resonance is radiated from the resonance radiation unit of the resonator.

The vibrator has an inherent internal impedance. This impedance can be apparently reduced (or preferably invalidated) upon operation of the drive control means in the vibrator drive means.

For this reason, the vibrator becomes an element responsive to only an electrical drive signal input, and does not essentially become a resonance system. At the same time, the volume of the resonator does not influence low-frequency reproduction power of the vibrator. Thus, if the cabinet is rendered compact, bass reproduction without including distortion due to a transient response of the vibrator can be realized. Since the Q value near the resonance frequency of the resonator can be a sufficiently large value, bass reproduction with a sufficient sound pressure can be realized. The Q value can be set by an equivalent resistance of a resonance radiation unit (opening port), and the resonance frequency can be set by adjusting an equivalent mass of the resonance radiation unit (port). Therefore, the volume of the resonator does not influence the low-frequency reproduction power.

As shown in the mechanical or electric equivalent circuit, since a vibration system constituted by the vibrator and a resonance system constituted by the resonator can be dealt with independently as much as possible (preferably, completely independently), the mutual dependency between the above systems on design can be eliminated (or preferably, removed) without causing any problem. Thus, designing can be much facilitated.

As described above, the compact size and bass reproduction can be simultaneously achieved, and designing can be facilitated.

DETAILED DESCRIPTION OF THE PREFERRED EMBODIMENTS

Figure 1A:
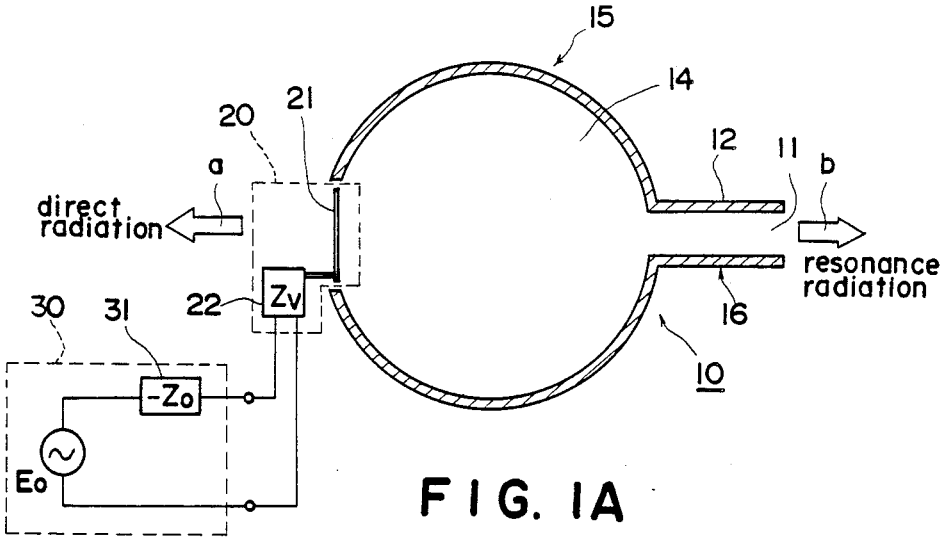
FIGS. 1A and 1B are diagrams for explaining a basic arrangement of an embodiment of the present invention.

A preferred embodiment of the present invention will be described hereinafter with reference to FIGS. 1 to 28. The same reference numerals in the drawings denote the same parts to avoid repetitive descriptions.

Figure 1B:
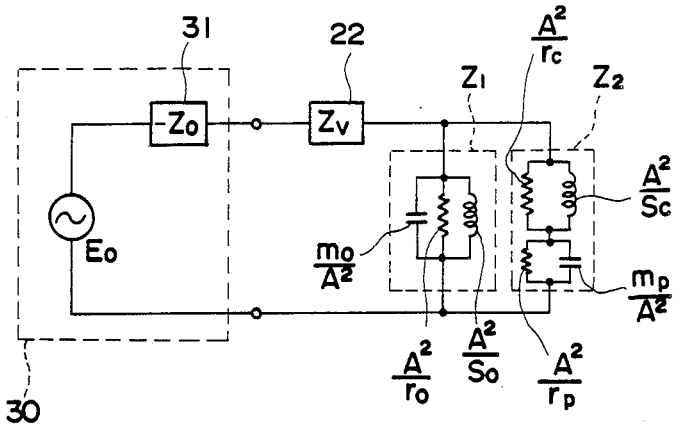

FIGS. 1A and 1B show a basic arrangement of an embodiment of the present invention. As shown in FIG. 1A, in this embodiment, a Helmholtz's resonator 10 having an opening port 11 and a neck 12 serving as a resonance radiation unit is used. In the Helmholtz's resonator 10, a resonance phenomenon of air is caused by a closed cavity 14 formed in a body portion 15 and a short tube or duct 16 constituted by the opening port 11 and the neck 12. The resonance frequency $f_{op}$ is given by:

$$f_{op}=c(S/lV)^{\frac{1}{2}}/2\pi \quad (1)$$

where c: velocity of sound

S: sectional area of duct 16 l: length of neck 12 of duct 16

V: volume of cavity 14

In the acoustic apparatus of this embodiment, a vibrator 20 constituted by a diaphragm 21 and a transducer 22 is attached to the body portion 15 of the resonator 10. The transducer 22 is connected to a vibrator driver 30, which comprises a negative impedance generator 31 for equivalently generating a negative impedance component ($-Z_0$) in the output impedance.

FIG. 1B shows an arrangement of an electric equivalent circuit of the acoustic apparatus shown in FIG. 1A. In FIG. 1B, a parallel resonance circuit $Z_1$ corresponds to an equivalent motional impedance of the vibrator 20, $r_o$ indicates an equivalent resistance of a vibration system of the vibrator 20; $S_o$, an equivalent stiffness of the vibration system; and $m_o$, an equivalent mass of the vibration system. A series resonance circuit $Z_2$ corresponds to an equivalent motional impedance of the Helmholtz's resonator 10, $r_c$ indicates an equivalent resistance of the cavity 14; $S_c$, an equivalent stiffness of the cavity 14; $r_p$, an equivalent resistance of the duct 16; and $m_p$, an equivalent mass of the duct 16. In FIG. 1B, reference symbol A denotes a force coefficient. For example, if the vibrator 20 is a dynamic direct radiation speaker, $A=Bl_v$ where B is the magnetic flux density in the magnetic gap, and $l_v$ is the length of the voice coil conductor. Furthermore, in FIG. 1B, $Z_v$ indicates an inherent internal impedance of the transducer 22. For example, if the vibrator is a dynamic direct radiation speaker, the impedance $Z_v$ mainly serves as a DC resistance of the voice coil, and includes a small inductance.

The operation of the acoustic apparatus with the arrangement shown in FIG. 1A will be briefly described below.

When a drive signal is supplied from the vibrator driver 30 having a negative impedance drive function to the transducer 22 of the vibrator 20, the transducer 22 electromechanically converts the drive signal so as to reciprocally drive the diaphragm 21 forward and backward (in the right and left directions in FIG. 1A. The diaphragm 21 mechanical-acoustically converts this reciprocal motion. Since the vibrator driver 30 has the negative impedance drive function, the internal impedance inherent to the transducer 22 is essentially decreased (ideally invalidated). Therefore, the transducer 22 drives the diaphragm 21 faithfully in response to the drive signal from the vibrator driver 30, and independently supplies a drive energy to the Helmholtz's resonator 10. In this case, the front surface side (the left surface side in FIG. 1A) of the diaphragm 21 serves as a direct radiator portion for directly and externally radiating acoustic waves, and the rear surface side (the right surface side in FIG. 1A) of the diaphragm 21 serves as a resonance driver portion for driving the Helmholtz's resonator 10.

For this reason, as indicated by an arrow a in FIG. 1A, an acoustic wave is directly radiated from the diaphragm 21, and air in the Helmholtz's resonator 10 is resonated, so that a super-bass acoustic wave having a sufficient sound pressure is resonated and radiated from the resonance radiation unit as indicated by an arrow b. By adjusting an air equivalent mass in the duct 16 of the Helmholtz's resonator 10, the resonance frequency $f_{op}$ is set to be lower than the reproduction frequency range of the vibrator 20, and by adjusting the equivalent resistance of the duct 16, the Q value is set to be an appropriate level, so that a sound pressure of an appropriate level can be obtained from the opening port 11. By these adjustments, sound pressure-frequency characteristics shown in, e.g., FIG. 2 can be obtained.

This will be explained with reference to the equivalent circuits shown in FIGS. 3 and 4.

Figure 3:
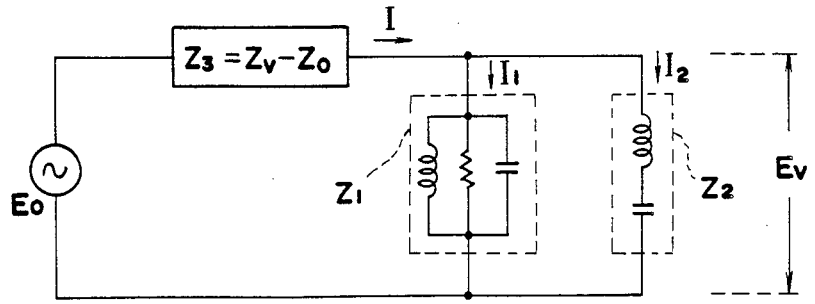
FIG. 3 is an electric equivalent circuit diagram of FIG. 1A.

FIG. 3 shows a simplified electric equivalent circuit of FIG. 1B. In other words, FIG. 3 is an equivalent circuit diagram regardless of the equivalent resistances $r_c$ and $r_p$ since the equivalent resistance $r_c$ of the cavity 14 and the equivalent resistance $r_p$ of the duct 16 are sufficiently small, and hence, their reciprocal components are extremely large. In FIG. 3, if I indicates a current flowing through the circuit, and $I_1$ and $I_2$ indicate currents flowing through the parallel and series resonance circuits $Z_1$ and $Z_2$, respectively, equations (2) to (4) below are established:

$$E_v=E_0\cdot\{Z_1\cdot Z_2/(Z_1+Z_2)\}/[\{Z_1\cdot Z_2/(Z_1+Z_2)\}+Z_3] \quad (2)$$

$$I_1=E_0\cdot\{Z_2/(Z_1+Z_2)\}/[\{Z_1\cdot Z_2/(Z_1+Z_2)\}+Z_3] \quad (3)$$

$$I_2=E_0\cdot\{Z_1/(Z_1+Z_2)\}/[\{Z_1\cdot Z_2/(Z_1+Z_2)\}+Z_3] \quad (4)$$

In order to simplify equations (3) and (4), if $Z_4=Z_1\cdot Z_2/(Z_1+Z_2)$, equation (3) is rewritten as:

$$I_1=E_0/\{Z_1(1+Z_3/Z_4)\} \quad (5)$$

and, equation (4) is rewritten as:

$$I_2=E_0/\{Z_2(1+Z_3/Z_4)\} \quad (6)$$

From equations (5) and (6), the following two points can be understood. First, if the $Z_3$ value approaches zero, the parallel resonance circuit $Z_1$ of the vibrator and the series resonance circuit $Z_2$ of the resonator approach a state wherein they are respectively short-circuited in an AC manner, accordingly. Second, the parallel and series resonance circuits $Z_1$ and $Z_2$ influence each other through $Z_3=Z_v-Z_0$, and the independencies of the parallel and series resonance circuits $Z_1$ and $Z_2$ are enhanced as the $Z_3$ value approaches zero.

Assuming an ideal state wherein $Z_3=Z_v-Z_0=0$, equations (5) and (6) are respectively given by:

$$I_1=E_0/Z_1 \quad (7)$$

$$I_2=E_0/Z_2 \quad (8)$$

Both the parallel and series resonance circuits $Z_1$ and $Z_2$ are short-circuited with a zero impedance in an AC manner, and can be regarded as perfectly independent resonance systems.

Figure 4:
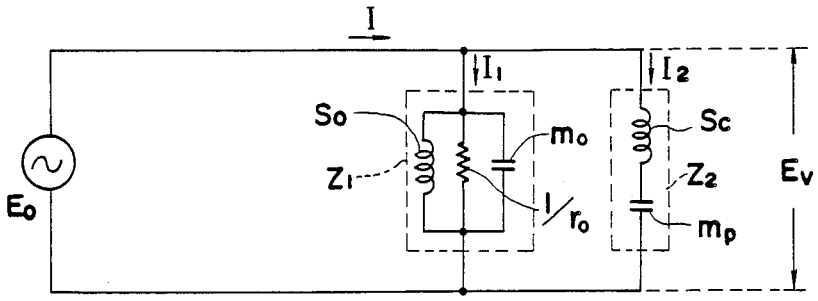
FIG. 4 is an equivalent circuit diagram obtained when $Z_3=0$ in FIG. 3.

FIG. 4 shows an equivalent circuit of FIG. 3 when $Z_0=Z_v$, i.e., when $Z_3=Z_v-Z_0=0$.

Strictly examining a resonance system of the vibrator 20, the two ends of the parallel resonance circuit $Z_1$ formed by the equivalent motional impedance are short-circuited with a zero impedance in an AC manner. Therefore, the parallel resonance circuit $Z_1$ is essentially no longer a resonance circuit. More specifically, the vibrator 20 linearly responds to a drive signal input in real time, and faithfully electroacoustically converts an electric signal (drive signal) $E_o$ without a transient response. In the vibrator 20, the concept of a minimum resonance frequency $f_o$ which is obtained when the vibrator is simply mounted on the Helmholtz's resonator 10 is not applicable. This is because the two ends of the parallel resonance circuit $Z_1$ of the vibrator 20 are short-circuited with a zero impedance in an AC manner. (In the following description, "a value corresponding to the minimum resonance frequency $f_o$ of the vibrator 20" refers to the above-mentioned concept which is not essentially applicable any longer.) The vibrator 20 and the Helmholtz's resonator 10 are independent of each other, and the vibrator 20 and the duct 16 are also independent of each other. For this reason, the vibrator 20 functions independently of the volume of the cavity 14 of the Helmholtz's resonator 10, the inner diameter of the opening port 11, the length of the neck 12, and the like (i.e., independently of the equivalent motional impedance $Z_2$ of the port resonance system).

The parallel and series resonance circuits $Z_1$ and $Z_2$ are present as resonance systems independently of each other. Therefore, if the Helmholtz's resonator 10 is designed to be compact in order to reduce the size of the system, or when the duct 16 is designed to be elongated in order to reduce the Q value of the port resonance system, as will be described later, the design of the unit vibration system is not influenced by the port resonance system at all, and the value corresponding to the minimum resonance frequency $f_o$ of the unit vibration system is not influenced by the port resonance system at all, either. For this reason, easy designing free from the mutual dependency condition is allowed.

From another point of view, since the unit vibration system $Z_1$ is not effectively a resonance system, if the drive signal input is zero volts, the diaphragm 21 becomes a part of the wall of the resonator 10. As a result, the presence of the diaphragm 21 can be ignored when the port resonance system is considered.

From still another point of view, in the acoustic apparatus of the present invention, the port resonance system is the only resonance system, and exhibits single-humped characteristics similar to those of the closed baffle.

In the parallel resonance system, the Q value given by the following relation becomes zero for the parallel resonance circuit $Z_1$:

(load resistance)/(resonance impedance)

Q=0 in the unit vibration system has some other significances.

First, the vibrator 20 equivalently forming the parallel resonance circuit $Z_1$ becomes a speaker which is driven by a current source given by $E_v/(A^2/r_o)$ which is determined by the input voltage $E_v$ and a resistance $A^2/r_o$ of the parallel resonance circuit $Z_1$. A current drive region in an electrical sense is equivalent to a velocity drive region in a mechanical sense, and frequency characteristics of an acoustic wave near the value corresponding to the minimum resonance frequency $f_o$ of this speaker are 6 dB/oct. In contrast to this, characteristics in a normal voltage drive state are 12 dB/oct.

Second, the diaphragm 21 can be in a perfectly damped state. More specifically, for a reaction caused by driving the diaphragm 21, control is made to overcome the reaction by increasing/decreasing the drive current. Therefore, for example, when an external force is applied to the diaphragm 21, a counter drive force acts at that moment until a state balanced with the external force is established (active servo).

The resonance system constituted by the cavity 14 and the duct 16 will be examined below with reference to FIG. 4.

As shown in FIG. 4, the two ends of the series resonance circuit $Z_2$ are also short-circuited with 0Ω in an AC manner. However, in this case, unlike the parallel resonance circuit $Z_1$ described above, the significance of the resonance system is not lost at all. Conversely, the Q value of the resonance system becomes extremely large (if approximate to an ideal state $Q \approx \infty$). A driving operation of a virtual acoustic source (speaker) constituted by the opening port 11 of the Helmholtz's resonator 10 is achieved by a displacement (vibration) of the diaphragm 21 in practice. It is considered for the equivalent circuit shown in FIG. 4 that a drive energy is supplied from the drive source $E_v$ in parallel with the vibrator 20. For this reason, by setting the resonance frequency and the resonance Q value in the resonator independently of the vibrator, super-bass reproduction with a sufficient sound pressure can be achieved by a compact system.

Here, since the series resonance circuit $Z_2$ of the port resonance system is present completely independently of the parallel resonance circuit $Z_1$ of the unit vibration system, the design specifications of cavity 14 and duct 16 of the Helmholtz's resonator 10 are not influenced by the design specifications of the vibrator 20. Therefore, easy designing free from the mutual dependency condition is allowed.

For the virtual speaker (the acoustic source by the Helmholtz's resonator 10), from equations (7) and (8) described above, the current I flowing through the transducer 22 of the vibrator is:

$$I = I_1 + I_2 = (1/Z_1 + 1/Z_2)E_0 \quad (9)$$

From equation (8), $Z_2$ value approximates 0 near the resonance frequency $f_{op}$ of the opening port 11 in a state wherein the port resonance system causes Helmholtz's resonance (however, $Z_2$ is damped by a resistance component in practice), and hence, the current $I_2$ can be obtained by a voltage of a very small amplitude.

Since the value corresponding to the minimum resonance frequency $f_o$ of the vibrator 20 is higher than the resonance frequency $f_{op}$ of the opening port 11, the $Z_1$ value is sufficiently large near the resonance frequency $f_{op}$. For this reason, equation (9) can be rewritten as:

$$I = I_1 + I_2 \approx I_2$$

Almost all the current flowing through the transducer 22 of the vibrator 20 contributes to driving of the port resonance system (virtual speaker). Since the port resonance system is driven by a small-amplitude voltage (large current), this means that the transducer 22 connected in parallel therewith is also driven by the small-amplitude voltage. Therefore, the diaphragm 21 performs a small-amplitude operation. In this case, since the diaphragm 21 performs the small-amplitude operation, a nonlinear distortion which usually occurs in a large-amplitude operation of a dynamic cone speaker can be effectively eliminated in, particularly, a super-bass range.

In the equivalent circuit shown in FIG. 4, the resonance Q value of the series resonance circuit $Z_2$ becomes infinite because of the series resonance system unlike the parallel resonance circuit $Z_1$ described above. In this case, the resonance Q value is accurately calculated based on the equivalent circuit shown in FIG. 1B:

$$Q=(m_p S_c)^{1/2}/(r_c+r_p)$$

Normally, $r_c$ and $r_p$ are very small, and if they are ignored as zero, the same result is also obtained. Therefore, if the Q value is set to be an appropriate value, a sufficient sound pressure can be obtained by this virtual speaker.

The Q value of the Helmholtz's resonator 10 can be normally controlled easier than the Q value of a speaker unit, and can be decreased as needed. For example, when the Helmholtz's resonator 10 is rendered compact, the resonance frequency $f_{op}$ of the resonance system of the opening port 11 can be decreased by decreasing the sectional area S of the opening port 11 or increasing the length l of the neck 12 in equation (1) described above:

$$f_{op}=c(S/lV)^{1/2}/2\pi$$

This means that in the acoustic apparatus of the present invention, setting for making the system compact and achieving super-bass reproduction becomes a factor for appropriately decreasing the Q value. More specifically, elongation of the duct 16 amounts to an increase in mechanical resistance (acoustic resistance) due to a air friction. Hence, in the equivalent circuit shown in FIG. 1B, since $A^2/r_l$ is decreased, the Q value of the series resonance circuit $Z_2$ on the side of the Helmholtz's resonator 10 is decreased, and as a result, the damping characteristics can be appropriately improved. This point forms a remarkable contrast with a conventional bass-reflex type speaker system wherein when a resonance frequency of an opening port is decreased, the Q value of the resonance system is extremely decreased, and finally, acoustic radiation power of the port is lost.

In addition, $A^2/r_c$ is decreased by inserting a sound absorbing material in the cavity 14 of the Helmholtz's resonator 10 so as to control the Q value to be a desired value. It is important that even if the Q value of the port resonance system is controlled under the condition of making the resonator (or cabinet) compact, the unit vibration system is not influenced.

Figure 2:
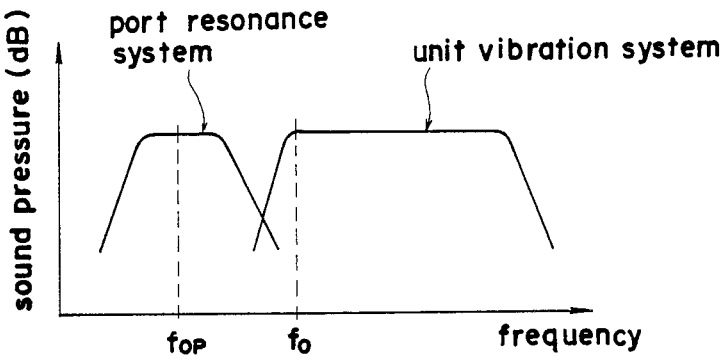
FIG. 2 is a graph showing sound pressure-frequency characteristics.

As can be seen from the above description, according to the present invention, the sound pressure-frequency characteristics shown in FIG. 2 can be readily realized by a compact apparatus (cabinet). The Q value is about zero near the value corresponding to the minimum resonance frequency $f_o$ of the unit vibration system expressed by the parallel resonance circuit $Z_1$, and the Q value of the series resonance circuit $Z_2$ can be desirably set near the resonance frequency $f_{op}$ of the port resonance system. In this case, in the whole apparatus, the port resonance system is the only resonance system, and the single-humped characteristics are obtained like in the conventional closed baffle. It is important that the designing of the unit vibration system and the port resonance system can be independently performed. Thus, the opening port 11 serves as a virtual speaker which operates independently of the vibrator 20 while being driven by the vibrator 20.

Although the virtual speaker can be realized with a small diameter corresponding to the diameter of the opening port, it corresponds to a very large-diameter speaker as an actual speaker in view of its bass reproduction power, and can provide remarkable effects for dimensional efficiency or sound source concentration. In this sense, cost efficiency is very large. The virtual speaker includes not an actual diaphragm but a virtual diaphragm constituted by only air, and can be an ideal one.

In the description of the basic arrangement, the ideal state is assumed to be:

$$Z_3=Z_v-Z_0=0$$

Essentially, the effect of the present invention can be sufficiently obtained if:

$$0\leqq Z_3<Z_v$$

This is because the resonance Q value of the port resonance system is increased as the $Z_3$ value decreases, and the correlation between the unit vibration system and the port resonance system gradually disappears as the $Z_3$ value decreases. Therefore, in, e.g., a dynamic direct radiation speaker, if an internal resistance of a voice coil is 8Ω, an equivalent negative resistance of −4Ω is generated to apparently reduce the resistance to 4Ω, so that satisfactory bass reproduction can be realized from the virtual speaker formed by the opening port 11.

It is not preferable that a negative impedance is set too large and the value of $Z_3=Z_v-Z_0$ becomes negative. This is because if $Z_3$ becomes negative, the circuit as a whole including a load has negative resistance characteristics, and causes oscillation. Therefore, if the value of the internal impedance $Z_v$ is changed due to heat during operation, the value of the negative impedance must be set with a certain margin or the value of the negative impedance must be changed (temperature-compensated) in accordance with a change in temperature.

Various embodiments which can be applied to the basic arrangement described above with reference to FIGS. 1 to 4 will be explained below.

The resonator is not limited to one shown in FIG. 1A. For example, the shape of the cavity or body portion is not limited to a sphere but can be a rectangular prism or cube. The volume of the resonator is not particularly limited, and can be designed independently of the unit vibration system. For this reason, the resonator can be rendered compact, resulting in a compact cabinet. The sectional shapes of the opening port and the neck constituting the resonance radiation unit are not particularly limited. For example, a sound path may extend externally, as shown in FIG. 1A or may be housed in the cavity. The neck 12 may be omitted, so that an opening is merely present. In addition, a plurality of openings may be formed. Furthermore, the resonance frequency $f_{op}$ can be appropriately set considering the correlation between the sectional area of the opening port and the length of the neck. Since the sectional area of the opening port can be appropriately set considering the correlation with the length of the neck, the opening of the port is reduced, so that a virtual bass-range speaker (woofer) can have a small diameter. Thus, a sound source can be concentrated to improve a sense of localization.

Various types of vibrator (electroacoustic transducer) such as dynamic type, electromagnetic type, piezoelectric type, and electrostatic type vibrators can be adopted, as shown in FIGS. 5 to 12.

Figure 5:
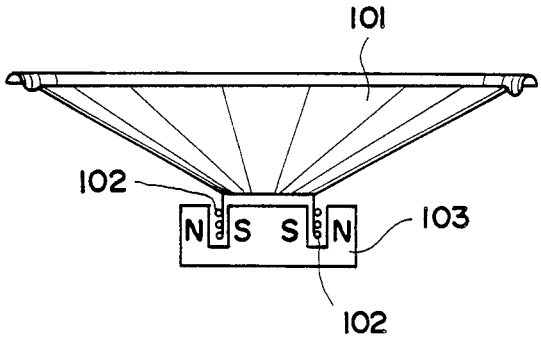
FIGS. 5 to 9 are views for explaining some examples of dynamic speakers.
Figure 6:
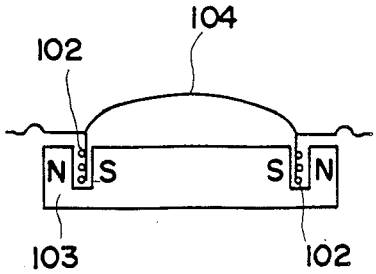

Diaphragms of dynamic speakers include cone, dome, ribbon, entire-surface drive, and hile driver types, as shown in FIGS. 5 to 9. A cone type dynamic speaker has a conical cone 101 as a diaphragm, as shown in FIG. 5, and a voice coil 102 is fixed near the top of the cone 101. The voice coil 102 is inserted in a magnetic gap formed in a magnetic circuit 103. In the cone type dynamic speaker, a non-motional impedance component appears mainly as a resistance. A dome type dynamic speaker shown in FIG. 6 is basically the same as the cone type dynamic speaker shown in FIG. 5, except that the diaphragm comprises a dome 104.

Figure 7:
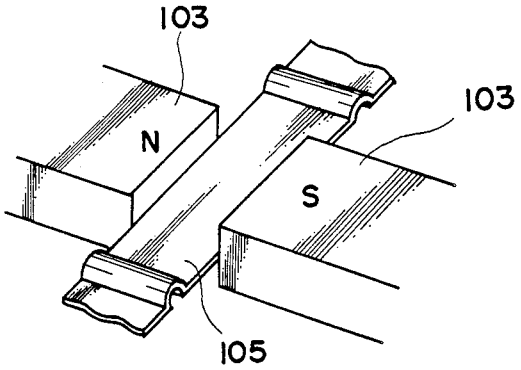

A ribbon type dynamic speaker is arranged such that a ribbon diaphragm 105 is disposed in a magnetic gap, as shown in FIG. 7. In a speaker of this type, a drive current is flowed in the longitudinal direction of the ribbon diaphragm 105, so that the diaphragm 105 is vibrated forward and backward (upward and downward in FIG. 7), thereby generating an acoustic wave. Therefore, the ribbon diaphragm 105 serves as both the voice coil and the diaphragm. In this speaker, the non-motional impedance component appears mainly as a resistance.

Figure 8:
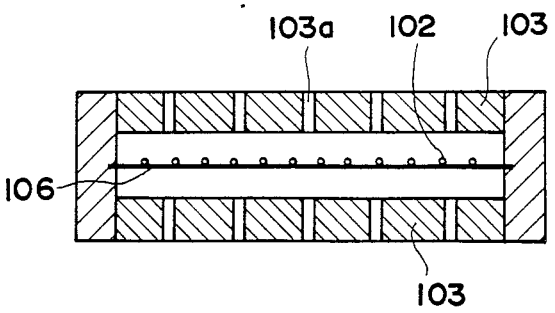

An entire-surface drive type dynamic speaker is arranged such that parallel magnetic plates 103 each having openings 103a for radiating acoustic waves are disposed, and a diaphragm 106 having a voice coil 102 is disposed therebetween, as shown in FIG. 8. Each magnetic plate 103 is magnetized so that its lines of magnetic force are parallel to the diaphragm 106. The voice coil 102 is fixed on the diaphragm 106 in a spiral shape.

Figure 9:
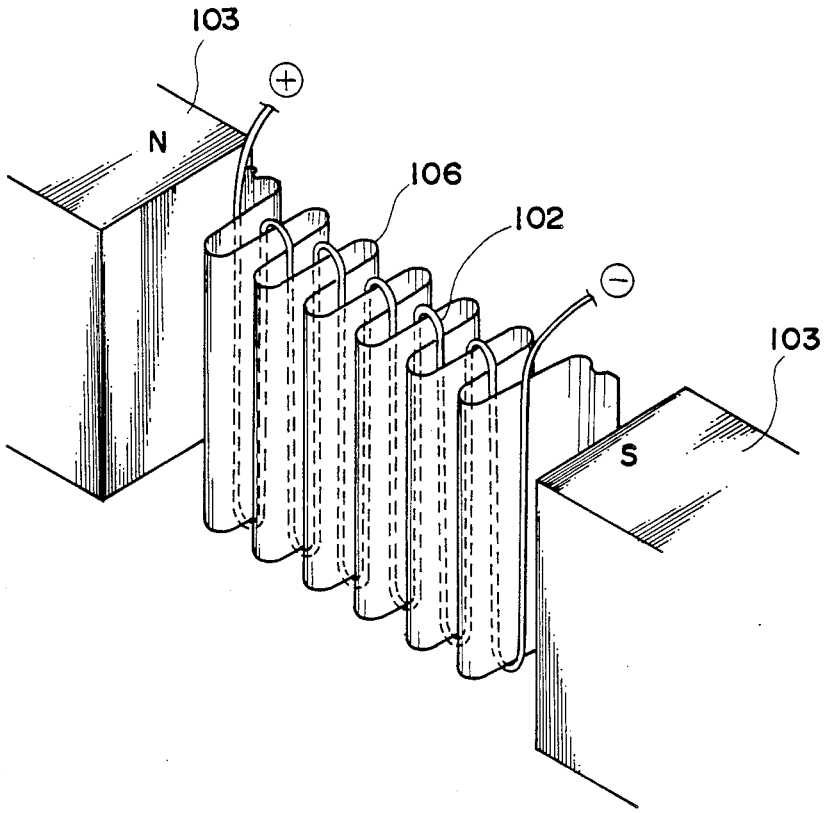

In a hile driver type dynamic speaker shown in FIG. 9, the voice coil 102 is also disposed on the diaphragm 106. More specifically, the diaphragm 106 is arranged in a bellows-like shape, and the voice coil 102 is fixed thereto in a zig-zag manner. With this speaker, the bellows of the diaphragm 106 is alternately expanded/contracted, thus radiating an acoustic wave. In this speaker, a non-motional impedance component appears mainly as a resistance.

Figure 10:
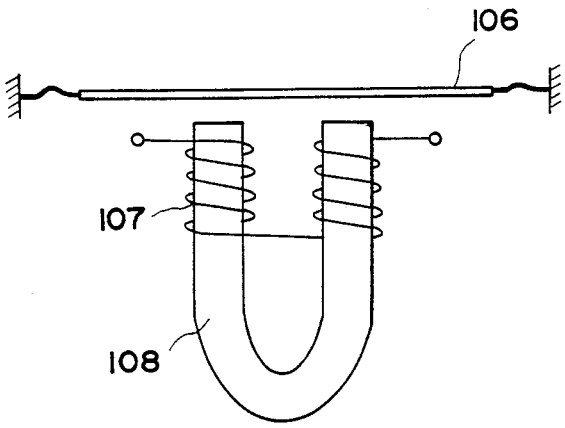
FIG. 10 is a view for explaining an example of an electromagnetic speaker.

An electromagnetic speaker as shown in FIG. 10 is known. As shown in FIG. 10, a diaphragm 106 arranged in a vibration free state includes a magnetic member, and an iron core 108 around which a coil 107 is wound is arranged near the diaphragm 106. In this speaker, a drive current is flowed through the coil 107, so that the diaphragm 106 is vibrated by the lines of magnetic force from the iron core 108, thus radiating an acoustic wave in the vertical direction in FIG. 10. In a speaker of this type, the non-motional impedance component appears mainly as a resistance.

Figure 11:
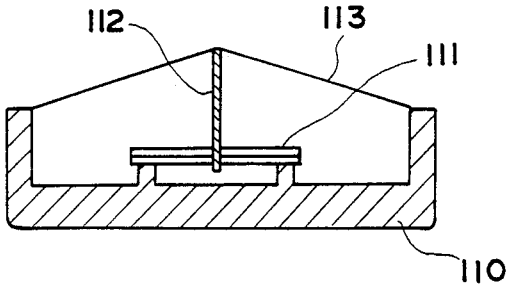
FIG. 11 is a sectional view for explaining an example of a piezoelectric speaker.

A piezoelectric speaker as shown in FIG. 11 is known. As shown in FIG. 11, two ends of a bimorph 111 which is vibrated by an electrostrictive effect are fixed to a support member 110, and a vibration rod 112 projects upright from the central portion of bimorph 111. The distal end of the oscillation rod 112 abuts against substantially the central portion of a diaphragm 113 fixed to the support member 110. In this speaker, the bimorph 111 is bent by the electrostrictive effect, so that its central portion is vibrated vertically. The vibration of the bimorph 111 is transmitted to the diaphragm 113 through the vibration rod 112. Therefore, the diaphragm 113 is vibrated in accordance with a drive current so as to radiate an acoustic wave. Note that in this speaker, the non-motional impedance component appears mainly as an electrostatic capacitance, or the like.

Figure 12A:
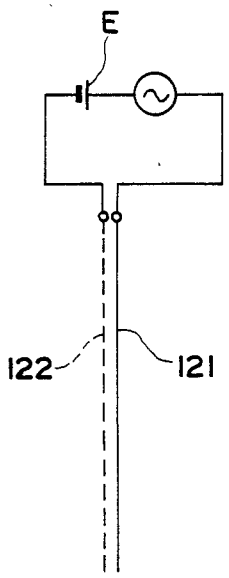
FIGS. 12A and 12B are circuit diagrams for explaining examples of electrostatic speakers.
Figure 12B:
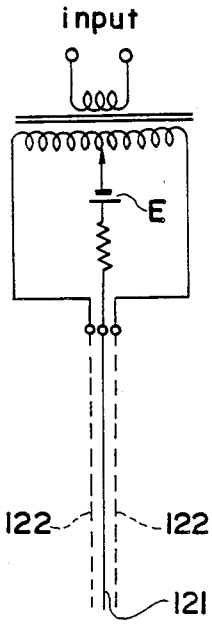

Electrostatic speakers as shown in FIGS. 12A and 12B are known. The speaker shown in FIG. 12A is called a single type capacitor type speaker, and the speaker shown in FIG. 12B is called a push-pull type capacitor type speaker. In FIG. 12A, a diaphragm 121 is juxtaposed near a mesh electrode 122, and receives an input signal superposed on a bias voltage E. Therefore, the diaphragm 121 is vibrated by an electrostatic effect, thus radiating an acoustic wave. In this case, since a reaction of a displacement current occurs due to vibration of the diaphragm 121, a negative impedance (capacitance) can be equivalently generated by utilizing this reaction current. In FIG. 12B, the diaphragm 121 is sandwiched between two mesh electrodes 122. The operation principle is the same as that of FIG. 12A. The non-motional impedance component appears mainly as an electrostatic capacitance.

Various negative impedance generating means as shown in FIGS. 13 to 21 are used.

Figure 13:
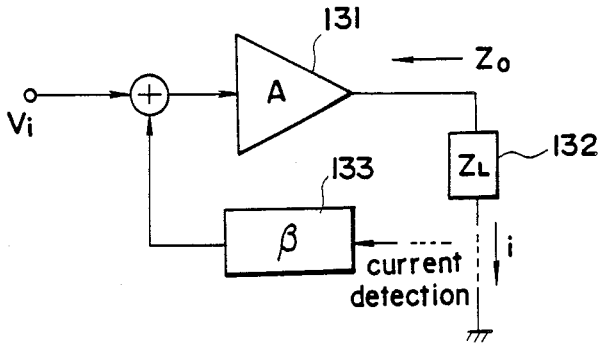
FIG. 13 is a circuit diagram showing a basic arrangement of a circuit for equivalently generating a negative impedance.

FIG. 13 shows the basic arrangement of such a means. As shown in FIG. 13, an output from an amplifier 131 having a gain A is supplied to a load $Z_L$ corresponding to a speaker 132. A current i flowing through the load $Z_L$ is detected, and the detected current is positively fed back to the amplifier 131 through a feedback circuit 133 having a transmission gain $\beta$. With this arrangement, an output impedance $Z_0$ of the circuit is calculated as:

$$Z_0 = Z_S(1 - A\beta) \quad (10)$$

If $A\beta > 1$ is established in equation (10), $Z_0$ becomes an open-circuit stable negative impedance. In equation (10), $Z_S$ is the impedance of a sensor for detecting a current.

Figure 14:
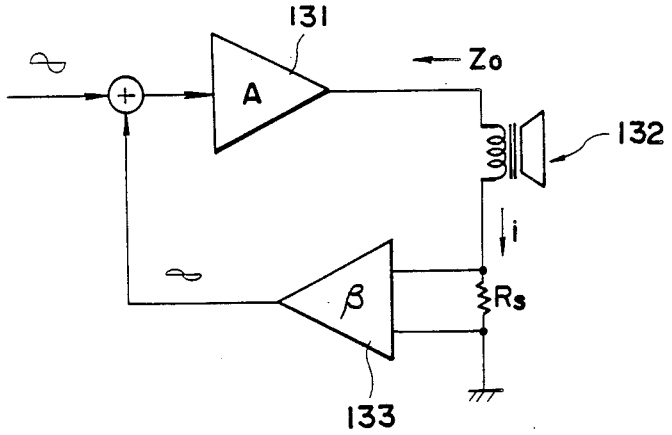
FIGS. 14 to 19 are circuit diagrams of circuits for generating an equivalently negative resistance.

FIG. 14 shows a circuit wherein the current i is detected by a resistance $R_s$ arranged at a ground side of the speaker 132. With this circuit, from equation (10) above, the output impedance $Z_0$ is:

$$Z_0 = R_s(1 - A\beta)$$

If $A\beta > 1$, the output impedance can include an apparent negative resistance component. Note that an embodiment corresponding to such a circuit is disclosed in Japanese Patent Publication No. sho 59-51771.

Figure 15:
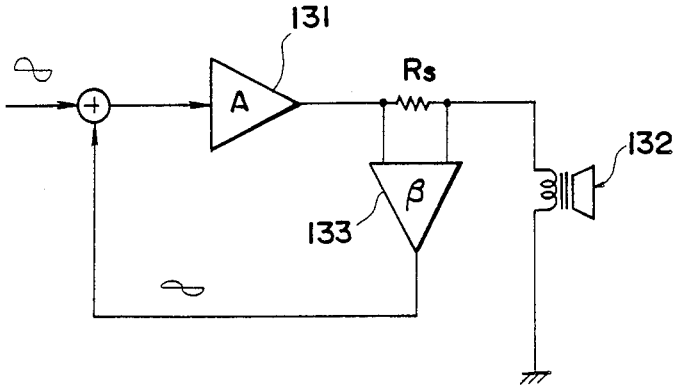
Figure 16:
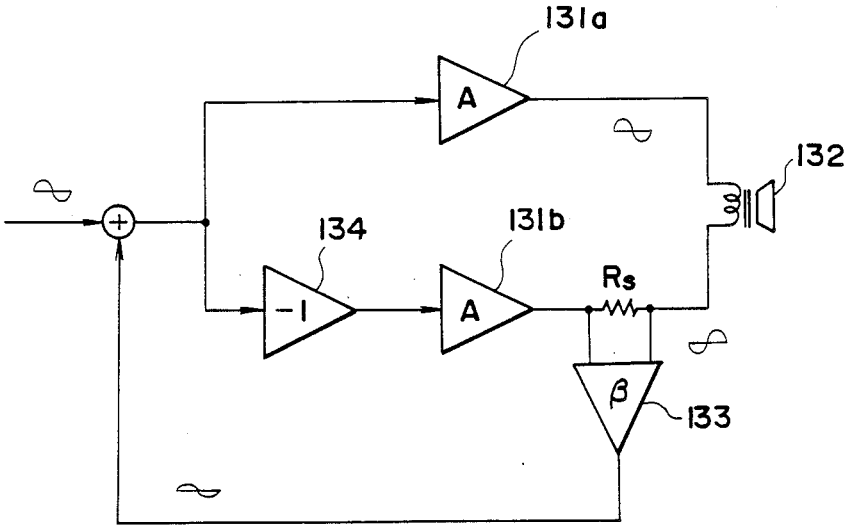

FIG. 15 shows a circuit wherein the current i is detected by a resistance $R_s$ arranged at a non-ground side of the speaker 132. With this circuit, the output impedance $Z_0$ can include a negative resistance component. Note that an embodiment corresponding to such a circuit is disclosed in Japanese Patent Publication No. sho 54-33704. FIG. 16 shows a circuit employing a BTL (balanced transformerless) connection. In FIG. 16, reference numeral 134 denotes an inverter. With this circuit, the output impedance $Z_0$ is given by:

$$Z_0 = R_s(1 - A\beta)$$

Figure 17:
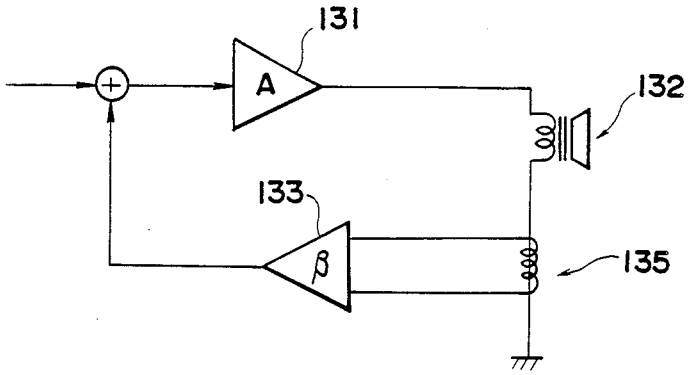

FIG. 17 shows a circuit wherein the current i is detected by a current probe. More specifically, since the current i forms an ambient magnetic field around a connecting line, the magnetic field is detected by a current probe 135, and is fed back to the amplifier 131 through the feedback circuit 133.

Figure 18:
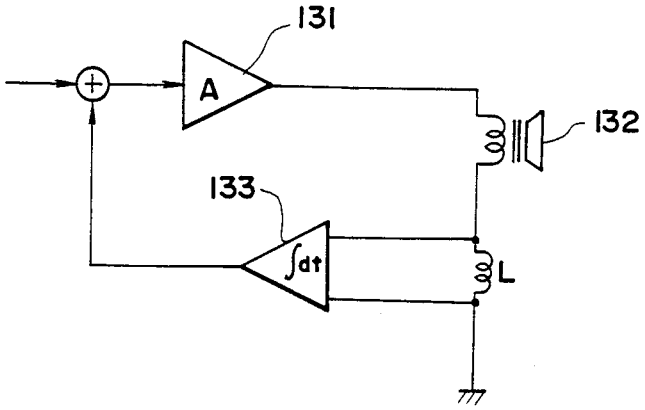

FIG. 18 shows a circuit wherein the feedback circuit 133 employs an integrator. More specifically, a voltage across an inductance L is integrated and detected, so that an operation equivalent to resistance detection can be performed. With this circuit, a loss can be reduced near a DC level below that in a case using the resistance $R_s$.

Figure 19:
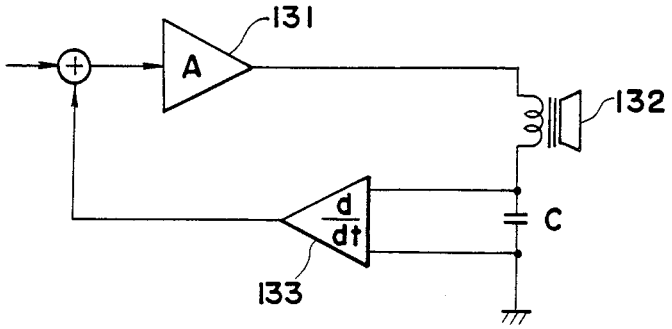

FIG. 19 shows a circuit wherein the feedback circuit 133 employs a differentiator. More specifically, a voltage across a capacitance C is differentiated and detected, so that an operation equivalent to resistance detection can be performed. In this circuit, since the capacitance C is inserted in a drive system of the speaker 132, a DC drive signal component may be cut.

Figure 20:
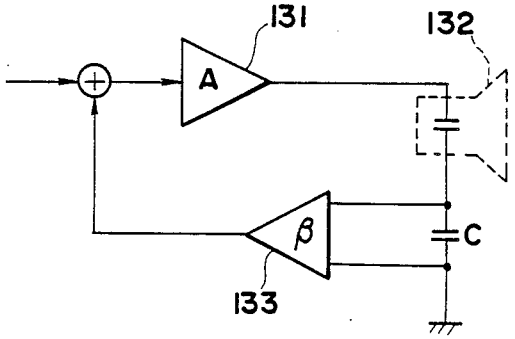
FIG. 20 is a circuit diagram of a circuit for generating an equivalently negative capacitance.

In the above-mentioned circuits, the output impedance $Z_0$ equivalently includes a negative resistance, and the above circuits are applied when a dynamic or electromagnetic type electroacoustic transducer is used. In contrast to this, if a piezoelectric or electrostatic type transducer (speaker) is used, the non-motional impedance component corresponds to a capacitance. Therefore, the output impedance $Z_0$ must equivalently include a negative capacitance. FIG. 20 is a circuit diagram of such a circuit. The speaker 132 comprises an electrostatic or piezoelectric speaker. The two ends of the capacitance C at the ground side of the speaker 132 are connected to the feedback circuit 133. With this circuit, from equation (10) above, the output impedance $Z_0$ is given by:

$$Z_0 = C(1 - A\beta)$$

Figure 21:
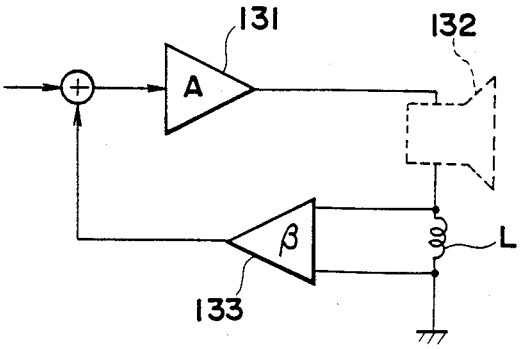
FIG. 21 is a circuit diagram of a circuit for generating an equivalently negative inductance.

When an electroacoustic transducer which includes an inductance as a non-motional impedance component is used, the output impedance $Z_0$ must include an equivalent negative inductance. Since a dynamic speaker or the like includes some inductance as the non-motional impedance component as well as a resistance, if the inductance component is to be invalidated, the negative inductance must be generated. FIG. 21 is a circuit diagram of such a circuit. As shown in FIG. 21, two ends of an inductance L at the ground side of the speaker 132 are connected to the feedback circuit 133. With this circuit, the output impedance $Z_0$ is given by:

$$Z_0 = L(1 - A\beta)$$

Embodiments of the present invention will be explained below.

Figure 22:
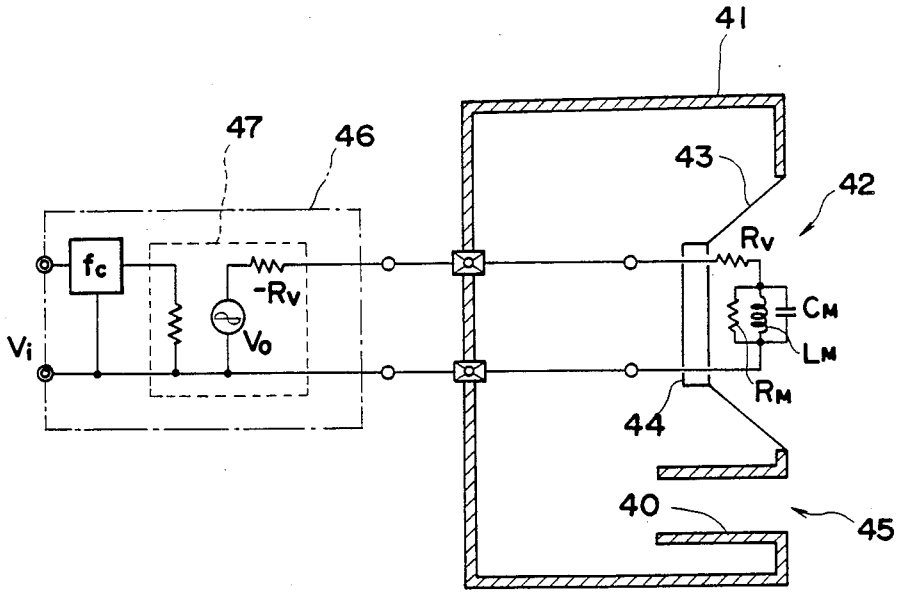
FIG. 22 is a diagram of an acoustic apparatus of the embodiment described in detail.

FIG. 22 is a diagram of an embodiment wherein the present invention is applied to a rectangular-prism cabinet. As shown in FIG. 22, a hole is formed in the front surface of a rectangular-prism cabinet 41, and a dynamic direct radiator speaker 42 is mounted therein. The speaker 42 is constituted by a conical diaphragm 43, and a dynamic transducer 44 arranged near the top of the diaphragm 43. An opening port 45 and a duct 40 are formed below the speaker 42 in the cabinet 41, and constitute a virtual woofer according to the present invention. A driver 46 has a servo circuit 47 for a negative resistance driving, and the dynamic transducer 44 is driven by the output from the servo circuit 47.

The dynamic transducer 44 has a voice coil DC resistance $R_v$ as an inherent internal impedance, while the driver 46 has an equivalent negative resistance component $(-R_v)$ in the output impedance. Therefore, the resistance $R_v$ is essentially invalidated. Reference symbols $R_M$, $I_M$ and $C_M$ denote motional impedances obtained when the speaker 42 are electrically equivalently expressed If the volume of the cabinet 41 is represented by V, the sectional area of the opening port 45 is represented by S, and the neck length of the duct 40 is represented by l, like in equation (1) described above, a resonance frequency $f_{op}$ is given by:

$$f_{op} = c(S/lV)^{1/2}/2\pi$$

Figure 23:
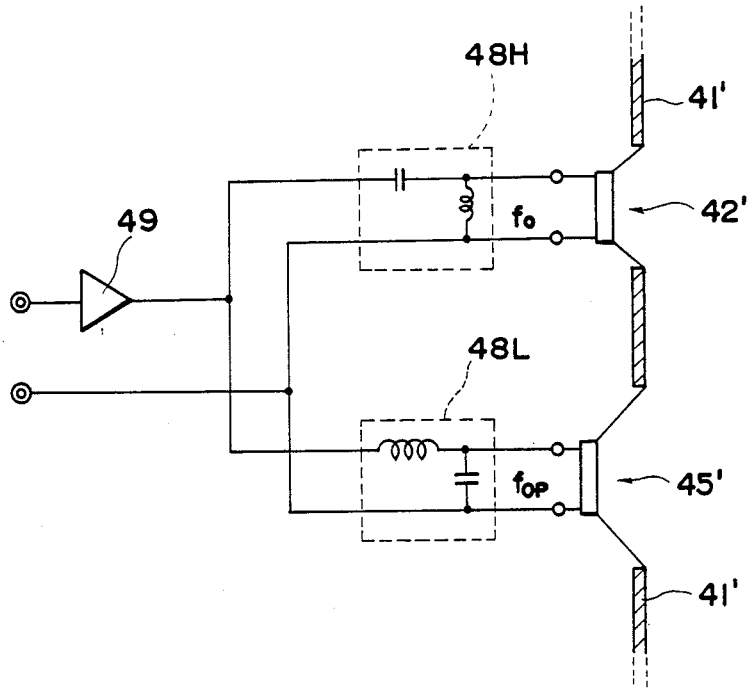
FIG. 23 is a diagram of an arrangement for explaining an equivalent operation of the apparatus shown in FIG. 22.

The arrangement of the equivalent operation of the embodiment shown in FIG. 22 is as shown in FIG. 23. More specifically, a middle/high range speaker 42' formed by the speaker 42 and a virtual woofer 45' equivalently formed by the opening port 45 are equivalent to a state wherein they are mounted on a closed cabinet 41' having an infinite volume. The speaker 42' is connected to a conventional amplifier 49 (which is not subjected to active servo drive) through an equivalently formed high-pass filter (HPF) 48H. The woofer 45' is connected to the amplifier 49 through an equivalently formed low-pass filter (LPF) 48L. (Note that the HPF 48H and LPF 48L are expressed as secondary HPF and LPF, respectively, for the sake of emphasizing a similarity to a conventional network circuit.) A minimum resonance frequency $f_o$ of the speaker 42' is determined by the equivalent motional impedances $R_M$, $L_M$, and $C_M$, and a resonance Q value is substantially zero, as has been described previously. The characteristics of the speaker 42' are not influenced at all by the design specifications of the virtual woofer 45'. The resonance frequency $f_{op}$ of the woofer speaker 45' is determined by only the opening port 45 and the duct 46, and a resonance Q value can be desirably controlled.

As can be apparent from the above description, according to the embodiment shown in FIGS. 22 and 23, the virtual woofer is equivalently formed by the opening port 45 and the duct 46. Since this arrangement is equivalent to a state wherein the speakers are mounted on a closed cabinet having an infinite volume, extremely excellent bass reproduction characteristics can be realized. The specifications of the speaker unit and the cabinet can be desirably designed without restricting each other, and the system can be rendered compact as compared with any conventional speaker systems having equivalent characteristics.

According to the present invention, as shown in FIG. 23, since the HPF 48H and the LPF 48L are equivalently formed, the arrangement of the driver can be simplified. For example, in a conventional two-way speaker system, HPF and LPF must be connected to inputs of a tweeter and a woofer, respectively. Since these filters must have capacitances and inductances, the cost of the driver tends to be increased, and the volume of the filters occupied in the driver tends to be also increased. In addition, their designs must be separately performed. In this invention, since these filters are equivalently formed, these prior art problems can be solved.

Sound pressure-frequency characteristics of the vibrator and the resonator as a whole can be arbitrarily set by increasing/decreasing an input signal level to an amplifier. Since both the vibrator and the resonator have sufficient acoustic radiation powers, the input signal level need only be adjusted, so that the sound pressure-frequency characteristics of the overall apparatus can be easily realized by wide-range uniform reproduction.

Some prototypes designed by the present inventor will be explained below.

Figure 24:
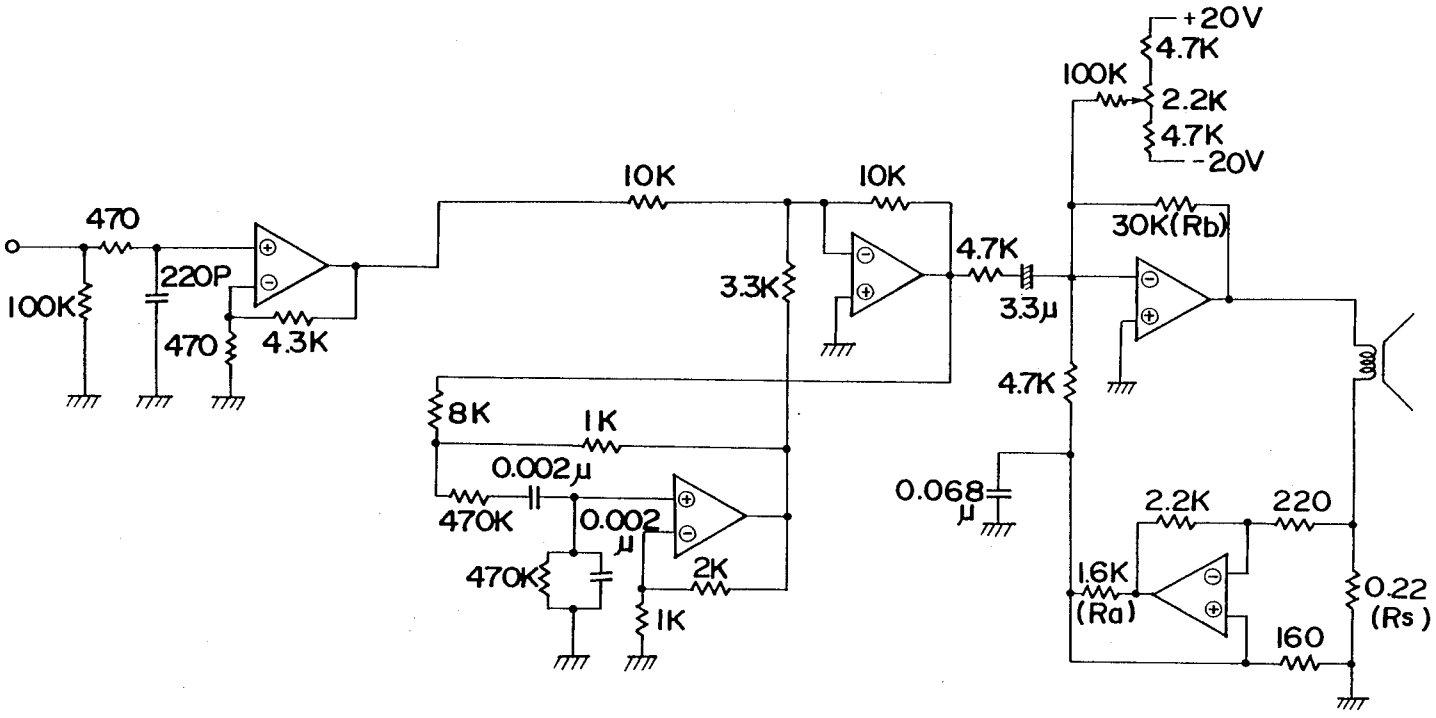
FIG. 24 is a circuit diagram when a two-way speaker system is realized using a single vibrator.

FIG. 24 is a circuit diagram of a driver used when a two-way speaker system is equivalently constituted using a single speaker unit and a single port resonance system (cabinet). In FIG. 24, the negative output impedance $Z_0$ is given by:

$$\begin{aligned} Z_0 &= R_s(1 - R_b/R_a) \\ &= 0.22(1 - 30/1.6) \\ &= -3.9(\Omega) \end{aligned}$$

Figure 25:
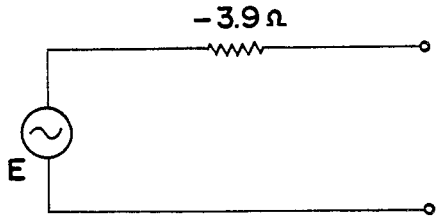
FIG. 25 is a diagram for explaining an output impedance equivalently formed in FIG. 24.

More specifically, in the circuit shown in FIG. 24, the equivalent output impedance is as shown in FIG. 25.

Figure 26:
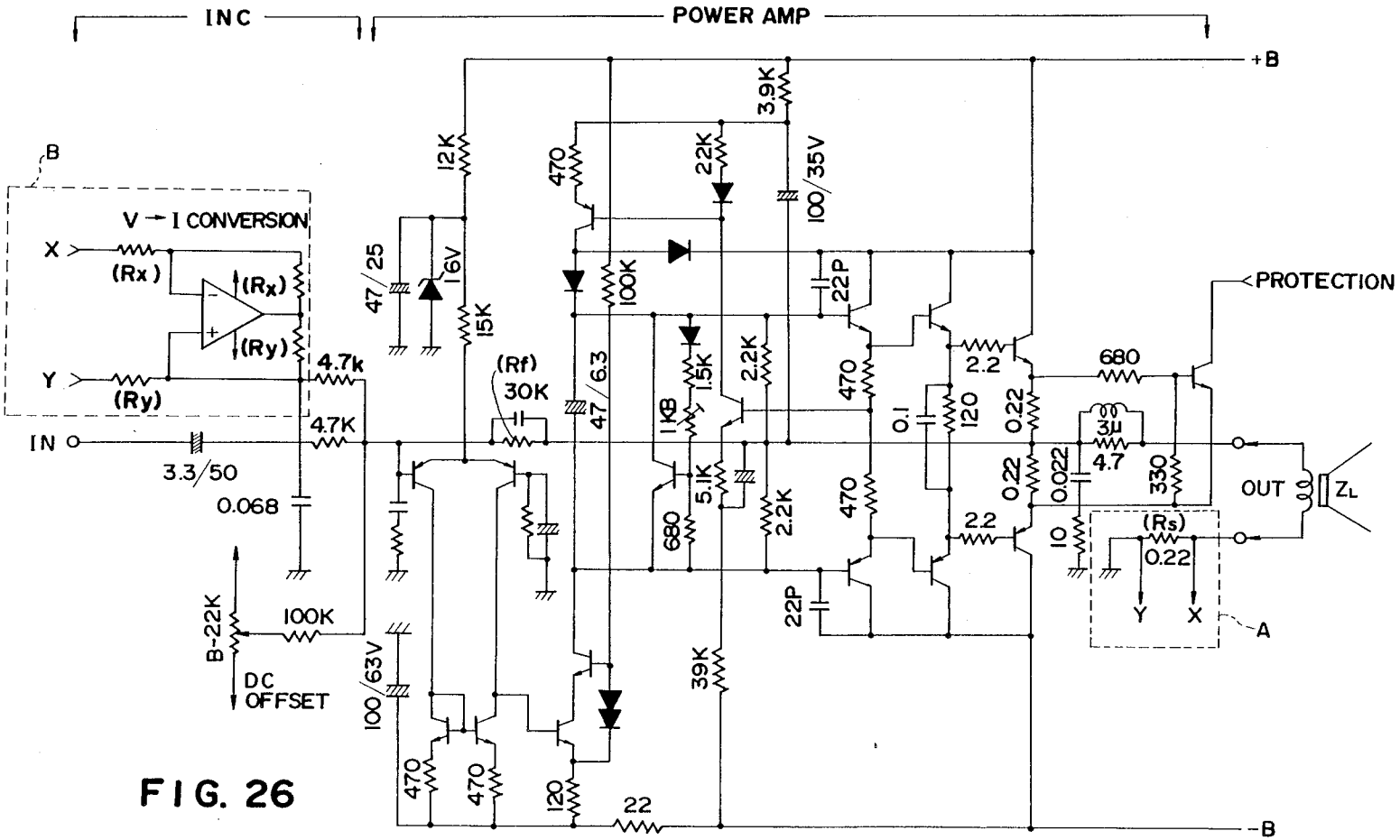
FIG. 26 is a circuit diagram of a negative resistance power amplifier having a low distortion factor.

FIG. 26 is a circuit diagram of a negative resistance power amplifier with a low distortion factor. In FIG. 26, an A portion enclosed by a dotted line corresponds to the detection resistance $R_s$ shown in FIGS. 14 and 24, and a B portion enclosed by a dotted line corresponds to a portion for reconverting a voltage corresponding to a detected current value into a current and feeding back the current to an input side, and corresponds to the circuit 133 in FIG. 14. Voltage-current conversion is performed to prevent an influence of a ground potential difference between the detection section and the input feedback section. In this circuit, the output impedance $Z_0$ is given by:

$$Z_0 = R_s(1 - R_f/R_y)$$

Therefore, since $R_f = 30\ k\Omega$, when $R_y < 30\ k\Omega$, the output impedance $Z_0$ can include an equivalent negative resistance component.

Figure 28:
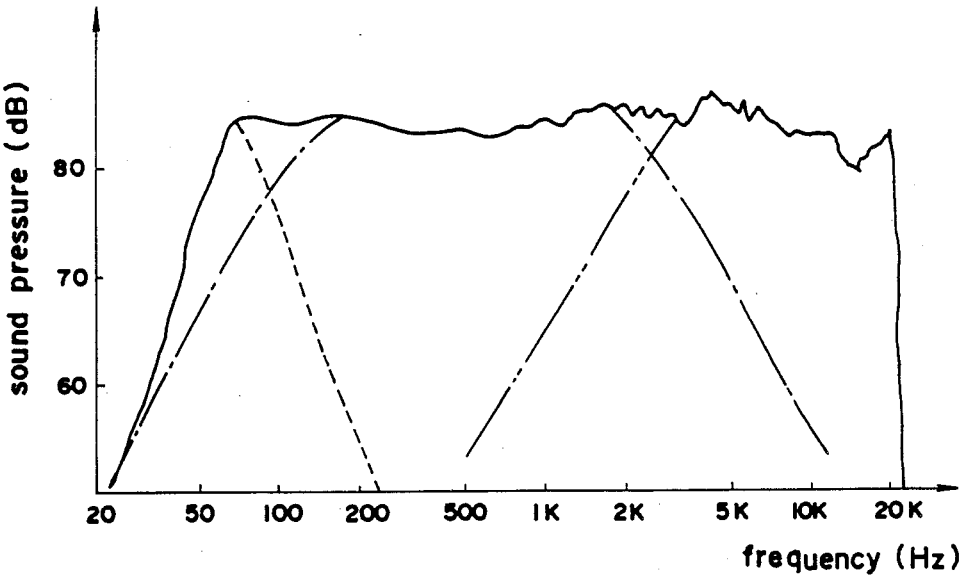
FIG. 28 is a graph showing sound pressure-frequency characteristics of the speaker system shown in FIG. 27.
Figure 27:
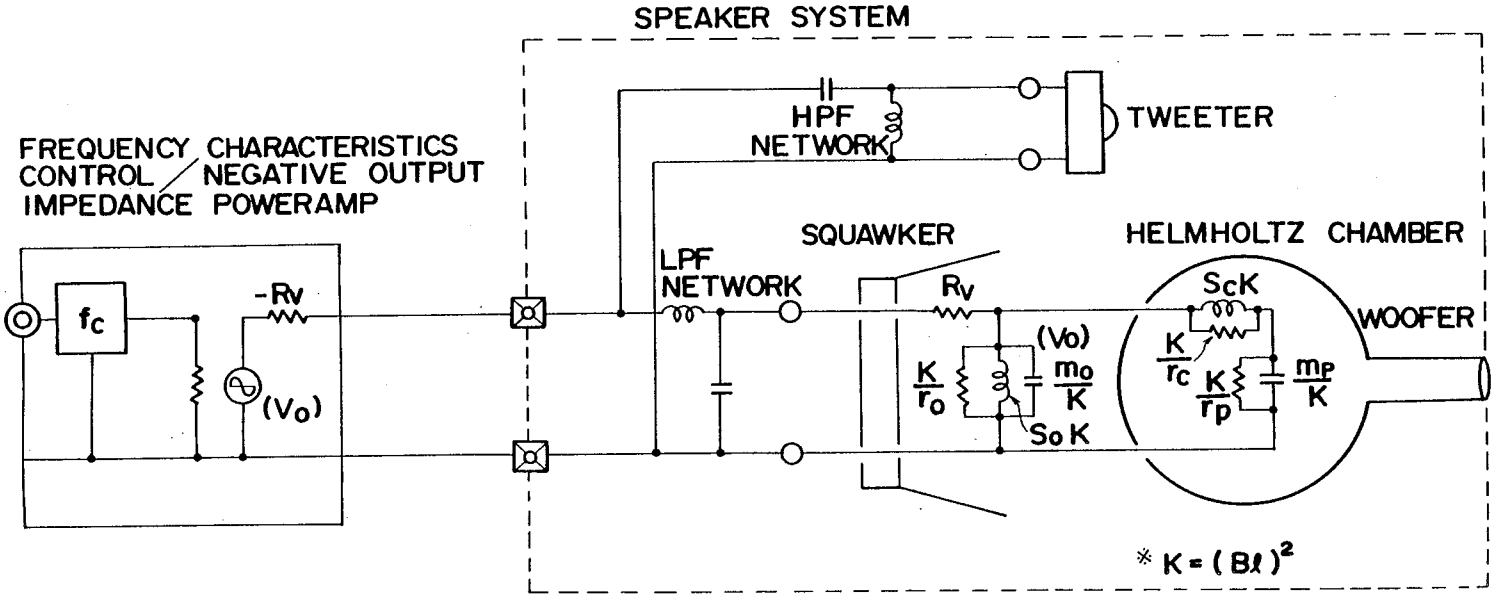
FIG. 27 is a circuit diagram when a three-way speaker system is realized using two vibrators.
Figure 29A:
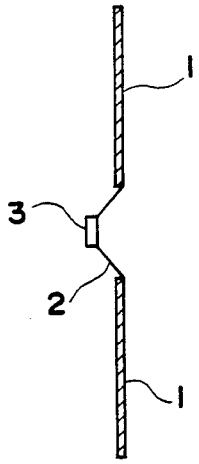
FIG. 29A PRIOR ART
FIGS. 29A to 29C are each a sectional view of a baffle used in a conventional speaker system.
Figure 29B:
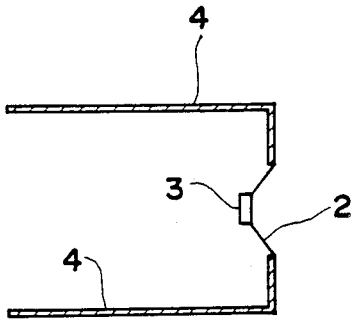
FIG. 29B PRIOR ART
Figure 29C:
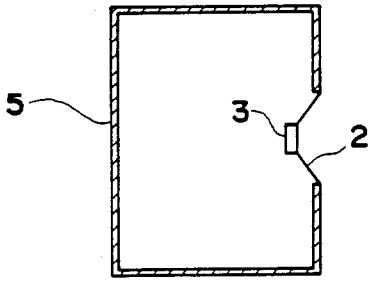
FIG. 29C PRIOR ART
Figure 30:
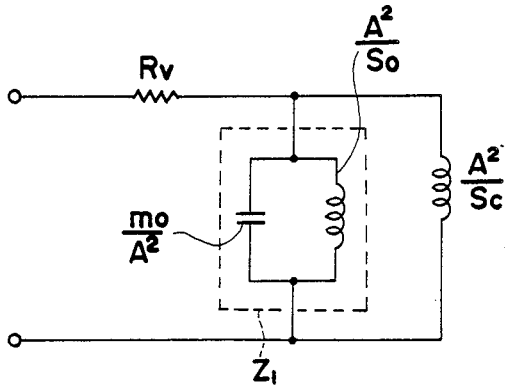
FIG. 30 PRIOR ART
FIG. 30 is an electric equivalent circuit diagram of a closed speaker system.
Figure 31A:
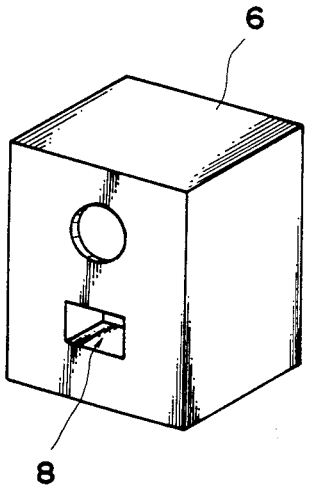
FIG. 31A PRIOR ART
FIGS. 31A and 31B are views together showing a bass-reflex type speaker system.
Figure 31B:
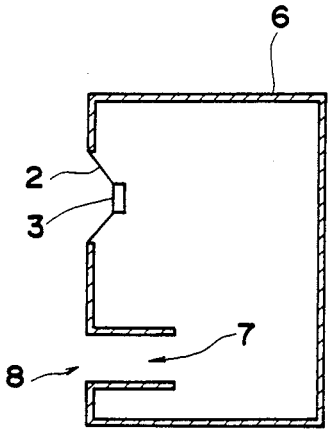
FIG. 31B PRIOR ART
Figure 32:
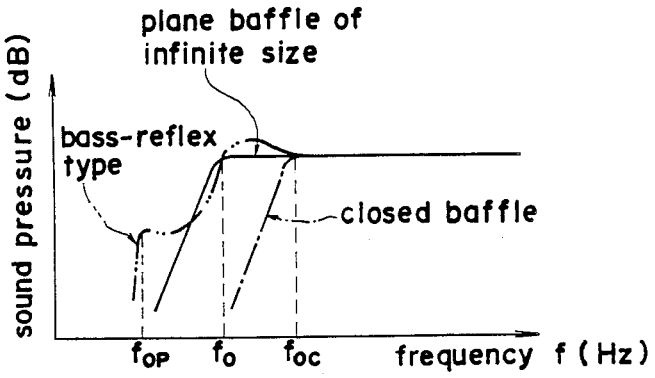
FIG. 32 PRIOR ART
FIG. 32 is a graph for comparing sound pressure-frequency characteristics of the prior arts.
Figure 33:
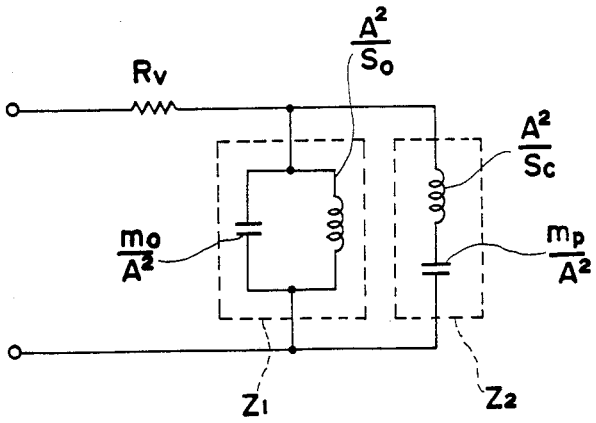
FIG. 33 is an electric equivalent circuit diagram of a bass-reflex speaker system.

FIG. 27 is a diagram when a three-way speaker system is constituted using two speaker units and a single port resonance system. With this arrangement, even when the volume V of a cavity of the Helmholtz's resonator is reduced to 3.5l, excellent sound pressure-frequency characteristics can be obtained, as indicated by a bold curve in FIG. 28. In FIG. 28, an alternate long and short dashed curve represents output characteristics of a middle-range speaker, and an alternate long and two short dashed curve represents output characteristics of a tweeter.

The present inventors obtained the following results upon comparison between the effect of the present invention and the effect of a bass-reflex type speaker system according to basic setting.

In an acoustic apparatus according to the present invention, the volume V of the cavity of the Helmholtz's resonator was 6l, the inner diameter of the opening port was 3.3 cm, and its neck length was 25 cm. When a negative resistance drive operation was performed with a dynamic cone speaker, bass reproduction to $f_{op} = 41$ Hz could be achieved. In contrast to this, in the bass-reflex type speaker system according to basic setting, when a dynamic cone speaker having $f_o = 50$ Hz, $Q = 0.5$, and a diameter $= 20$ cm was used, bass reproduction to $f_{op} = 41$ Hz was achieved when the volume of the cabinet was 176l. Therefore, it was found that the volume of the cabinet could be reduced to about 1/30 at an identical bass reproduction level according to the present invention.

Effect of the Invention

As has been described above in detail, according to the present invention, an internal impedance inherent to an vibrator can be apparently reduced (or preferably invalidated) upon operation of a drive control means in an vibrator drive means.

For this reason, the vibrator becomes an element responsive to only an electrical drive signal input, and performs an ideal operation without causing a transient response at all. In addition, the resonance system of the vibrator is essentially no longer a resonance system, and a diaphragm becomes equivalent to a wall surface of a resonator. Therefore, although the resonator is driven by the vibrator, it becomes an element which receives a drive energy independently of the vibrator. Since the resonator is free from the influence of the impedance of the vibrator, the resonance Q value of the resonator is extremely increased, and its acoustic radiation power becomes strong. As a result, if the resonance Q value of the resonator is decreased due to some other factors, the resonator can have a sufficient margin.

The bass reproduction characteristics of the vibrator do not depend on the volume of the resonator, and the resonance frequency of the resonator can be set by an equivalent mass of a resonance radiation unit. The volume of the resonator is not an element for controlling bass reproduction characteristics of the resonator itself. As a result, bass reproduction characteristics of the apparatus can be set regardless of the volume of the apparatus. Thus, a compact acoustic apparatus capable of bass reproduction can be easily realized.

As shown in the mechanically or electrically equivalent circuit, since the resonance system by the vibrator and the resonance system by the resonator can be controlled independently (preferably, perfectly independently), the mutual dependency condition therebetween on design can be eliminated (preferably, removed). Thus, an arbitrary band design can be readily achieved without any problem.

The acoustic apparatus of the present invention can be widely applied to sound sources of electronic or electric musical instruments, and the like as well as audio speaker systems.

What is claimed is:

1. An acoustic apparatus comprising:

a resonator having a resonance radiation unit for radiating an acoustic wave by resonance;

a vibrator having a diaphragm including a direct radiation portion for directly radiating an acoustic wave and a resonator driver portion for driving said resonator, the vibrator having an internal impedance; and a vibrator drive means for driving the vibrator, the drive means including drive control means for substantially counteracting the internal impedance of the vibrator so as to reduce the damping effect of the vibrator on the resonator by an amount sufficient to render the radiation characteristics of the resonator and vibrator independently controllable.

2. An apparatus according to claim 1, wherein said resonator comprises a cabinet having a first opening in which said vibrator is disposed and a second opening serving as said resonance radiation unit, and said diaphragm of said vibrator constitutes said direct radiator portion on a portion facing an outer region of said cabinet, and constitutes said resonator driver portion on a portion facing an inner surface of said cabinet.

3. An apparatus according to claim 1, wherein a resonance frequency of said resonator is different from a resonance frequency of said vibrator in a state wherein said vibrator is simply disposed in said resonator.

4. An apparatus according to claim 1, wherein a resonance frequency of said resonator is lower than a resonance frequency of said vibrator in a state wherein said vibrator is simply disposed in said resonator.

5. An apparatus according to claim 2, wherein said resonator comprises a Helmholtz's resonator having an opening port as said second opening.

6. An apparatus according to claim 5, wherein said opening port has a cylindrical neck.

7. An apparatus according to claim 1, wherein said vibrator comprises a dynamic electroacoustic transducer.

8. An apparatus according to claim 1, wherein said vibrator comprises an electromagnetic electroacoustic transducer.

9. An apparatus according to claim 1, wherein said vibrator comprises an electrostatic electroacoustic transducer.

10. An apparatus according to claim 1, wherein said vibrator comprises a piezoelectric electroacoustic transducer.

11. An apparatus according to claim 1, wherein said drive control means comprises negative impedance generating means for equivalently generating a negative impedance component in an output impedance of said vibrator drive means.

12. An apparatus according to claim 11, wherein said negative impedance generating means is arranged to positively feed back a signal corresponding to a drive current of said vibrator to an input side of said vibrator drive means, thereby equivalently generating the negative impedance component.

13. An apparatus according to claim 12, wherein said negative impedance generating means is arranged to equivalently generate the negative resistance component in an output impedance.

14. An acoustic apparatus comprising:

a resonator having a resonance radiation unit for radiating an acoustic wave by resonance;

a vibrator having a diaphragm including a direct radiation portion for directly radiating an acoustic wave and a resonator driver portion for driving said resonator; and a vibrator drive means, having a negative output impedance substantially equal to an internal impedance of said vibrator, whereby the vibrator is rendered substantially independent of the resonator.

15. An acoustic apparatus, comprising:

a resonator having a resonance radiation unit for radiating an acoustic wave by resonance;

a vibrator having a diaphragm including a direct radiation portion for directly radiating an acoustic wave and a resonator driver portion for driving the resonator, the vibrator having an internal impedance and the resonator and vibrator having an equivalent circuit including a resonance circuit of the vibrator connected in parallel with a resonance circuit of the resonator, each of said resonance circuits connected in series with the internal impedance of the vibrator; and an amplifier for driving the vibrator, said amplifier having a negative output impedance which is in series with and substantially the same magnitude as the internal impedance whereby the resonance circuits of the vibrator and resonator are rendered substantially independent from one another.

16. An acoustic apparatus comprising:

a resonator having a resonance radiation unit for radiating an acoustic wave by resonance and a vibrator having a diaphragm including a direct radiation portion for directly radiating an acoustic wave and a resonator driver portion for driving the resonator, said resonator having design specifications of resonance frequency and resonance Q set to desired values independent of possible overdamping of the resonator by the vibrator, the vibrator having an internal impedance; and drive means for driving the vibrator, the drive means including drive control means for counteracting the internal impedance of the vibrator whereby the resonator has the desired Q value despite the presence of the vibrator.

17. An acoustic apparatus as in claim 16 wherein the drive means is an amplifier and the control means includes means for causing the amplifier to have a negative output impedance.

* * * * *